US012116098B2

(12) United States Patent
Thum et al.

(10) Patent No.: US 12,116,098 B2
(45) Date of Patent: Oct. 15, 2024

(54) MARINE TRANSMISSION AND DRIVE ARRANGEMENT FOR A MARINE DRIVE

(71) Applicant: ZF Friedrichshafen AG, Friedrichshafen (DE)

(72) Inventors: Alexander Thum, Markdorf (DE); Hans Zorell, Oberteuringen (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 0 days.

(21) Appl. No.: 17/257,089

(22) PCT Filed: Jun. 26, 2019

(86) PCT No.: PCT/EP2019/066992
§ 371 (c)(1),
(2) Date: Mar. 25, 2021

(87) PCT Pub. No.: WO2020/015965
PCT Pub. Date: Jan. 23, 2020

(65) Prior Publication Data

US 2021/0206463 A1 Jul. 8, 2021

(30) Foreign Application Priority Data

Jul. 16, 2018 (DE) ..... 10 2018 211 767.5

(51) Int. Cl.
*B63H 23/06* (2006.01)
*B63H 23/02* (2006.01)

(52) U.S. Cl.
CPC ..... *B63H 23/06* (2013.01); *B63H 2023/0283* (2013.01)

(58) Field of Classification Search
CPC . B63H 23/06; B63H 2023/0283; B63H 23/10
See application file for complete search history.

(56) References Cited

U.S. PATENT DOCUMENTS 4,568,289 A * 2/1986 Heidrich ..... B63H 23/12 440/75

FOREIGN PATENT DOCUMENTS

| | | |
|---|---|---|
| DE | 1 099 385 B | 2/1961 |
| DE | 1 203 564 | 10/1965 |
| DE | 102 35 286 A1 | 2/2004 |
| EP | 1 123 865 A1 | 8/2001 |

(Continued)

OTHER PUBLICATIONS

International Search Report Corresponding to PCT/EP2019/066992 mailed Sep. 18, 2019.

(Continued)

*Primary Examiner* — Anthony D Wiest
(74) *Attorney, Agent, or Firm* — Finch & Maloney PLLC

(57) ABSTRACT

A marine transmission (1) with a main driveshaft (3), a first intermediate shaft (4) and a drive output shaft (6), by way of which at least one propeller (21) can be driven. The marine transmission (1) has an electric machine (7), as an additional drive, a second intermediate shaft (5) and a planetary gear assembly (8). The electric machine (7) can be connected to the second intermediate shaft (5) by way of the planetary gear assembly (8). Also a drive arrangement for a marine transmission with a main drive motor (2) and with a marine transmission (1) of that type are disclosed.

8 Claims, 1 Drawing Sheet

(56) References Cited

FOREIGN PATENT DOCUMENTS

| | | | |
|---|---|---|---|
| GB | 774234 A | * | 5/1957 |
| JP | 2017013715 A | * | 1/2017 |

OTHER PUBLICATIONS

Written Opinion Corresponding to PCT/EP2019/066992 mailed Sep. 18, 2019.

* cited by examiner

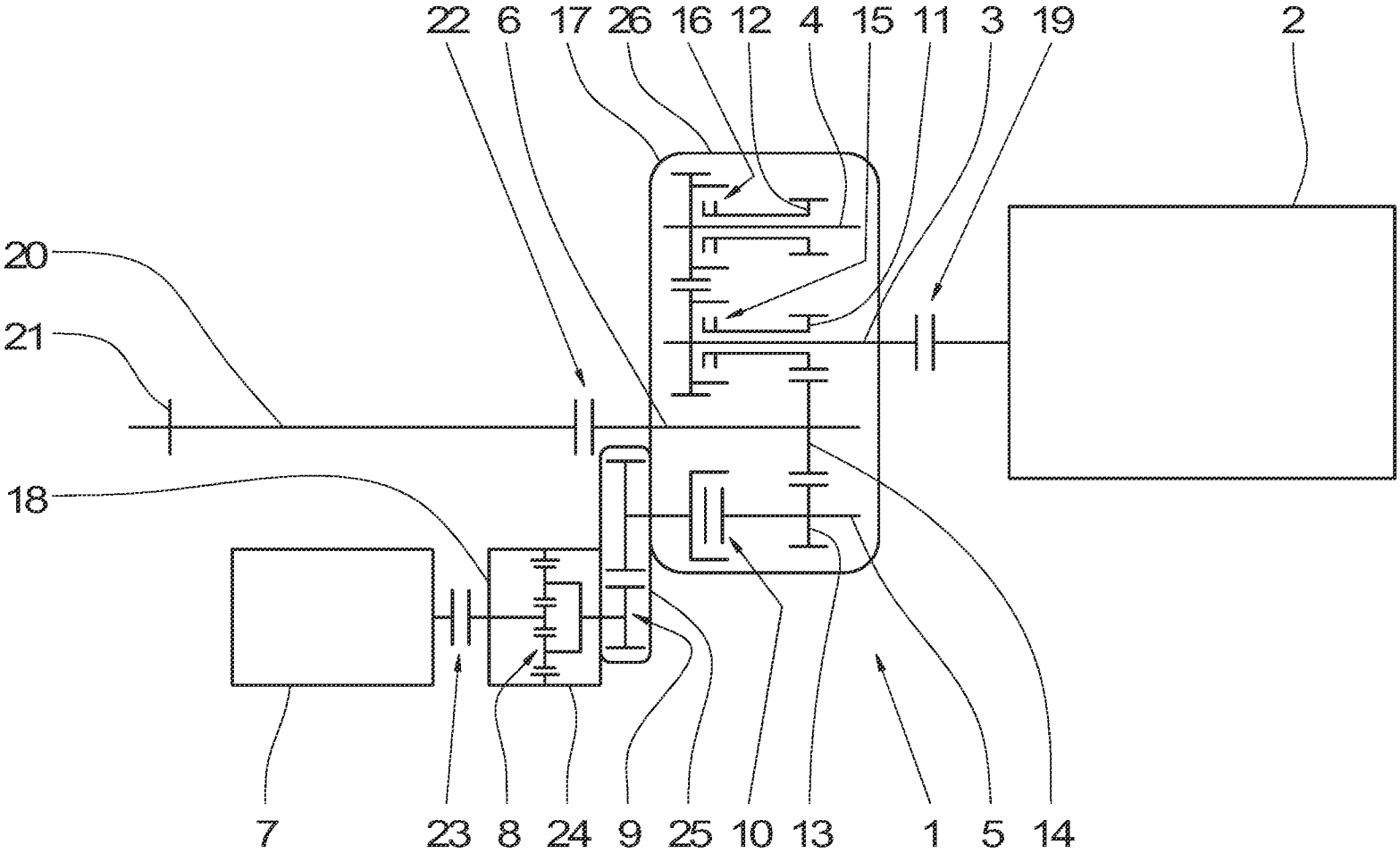
2
19
3
11
15
4
12
16
26
17
6
22
20
21
18
14
5
1
13
10
25
9
24
8
23
7

MARINE TRANSMISSION AND DRIVE ARRANGEMENT FOR A MARINE DRIVE

This application is a National Stage completion of PCT/EP2019/066992 filed Jun. 26, 2019, which claims priority from German patent application serial no. 10 2018 211 767.5 filed Jul. 16, 2018.

FIELD OF THE INVENTION

The invention relates to a marine and a drive arrangement for a marine drive.

BACKGROUND OF THE INVENTION

From EP 1 123 865 A1 a marine transmission is known, which comprises a driveshaft for connection to a drive motor, an intermediate shaft, and a drive output shaft for driving a propeller. In addition the possibility is described therein of coupling an additional motor to the intermediate shaft. Additional drive inputs for a marine transmission are also known as PTIs (Power Take-Ins in English).

SUMMARY OF THE INVENTION

The purpose of the present invention is to improve further such a marine transmission and a corresponding drive arrangement having an additional drive. In particular, the drive arrangement should be characterized by a wide range of applicability, a compact structure and as little as possible installation effort and expense.

These objectives are achieved with a marine transmission having the characteristics specified in the independent claim(s) and by a drive arrangement having the characteristics of the independent claim(s). Advantageous further embodiments of the invention are indicated in the respective dependent claims.

According to these a marine transmission is proposed, which comprises a main driveshaft, a first intermediate shaft and a drive output shaft. The main driveshaft can be connected to a main drive motor. By way of the drive output shaft, at least one propeller can be driven. In addition a connection for an additional drive is provided on the marine transmission. According to the invention the marine transmission comprises an electric machine as the additional drive, as well as a second intermediate shaft and a planetary gear assembly. In this case the electric machine can be connected to the second intermediate shaft by way of the planetary gear assembly.

The planetary gear assembly is necessary in order to reduce the relatively high rotational speeds of the electric machine to rotational speeds at which a propeller shaft can be driven by way of an intermediate shaft and the gear ratio steps of a conventional marine transmission. In this way conventional basic gear systems of marine transmissions can be used and upgraded with an additional drive. With the help of the planetary gear assembly, a high gear ratio between the electric machine and the intermediate shaft of the marine transmission can be produced with comparatively little space occupation. In turn, this allows an electric motor with a high rotational speed to be used as the electric machine. Furthermore, an electric motor has comparatively small dimensions compared with its power output. Consequently, a marine transmission for a hybrid drive, i.e. one with a combustion engine as its main drive motor and an electric motor as its additional drive can be produced, which advantageously takes up little structural space. Particularly by comparison with conventional drive arrangements in vessels in which a combustion engine is used as the additional drive, the proposed marine transmission with the electric machine takes up considerably less space.

The term "can be connected" means that the components mentioned in that context can be brought into connection with one another in such manner that torque and rotational movement can be transmitted by way of the connection. The components do not have to be permanently or firmly connected with one another. Instead they can, for example, be connected with or separated from one another by a shiftable clutch, as will be explained in greater detail below with reference to a preferred embodiment.

Preferably it is provided that a drive output gearwheel arranged on the drive output shaft engages with a first driving pinion, with a second driving pinion and with a third driving pinion. In this case the first driving pinion can be connected by a first powershiftable clutch to the main driveshaft. The second driving pinion can be connected by a second powershiftable clutch to the first intermediate shaft, and the third driving pinion is connected in a rotationally fixed manner to the second intermediate shaft. Thus, the drive output gearwheel can be connected to the electric machine via the third driving pinion and the second intermediate shaft. Consequently, the propeller can be driven by the electric machine by way of the second intermediate shaft, the third driving pinion and the drive output gearwheel. The first and second powershiftable clutches can for example each be in the form of a multi-disk clutch or disk clutch with an inner disk carrier and an outer disk carrier.

The outer disk carrier of the first powershiftable clutch can serve as the input element and can be connected firmly to the main driveshaft, whereas the inner disk carrier of the first powershiftable clutch is firmly connected to the first driving pinion. The inner disk carrier of the first powershiftable clutch can even be made integrally with the first driving pinion. The outer disk carriers of the first and second powershiftable clutches can each have external teeth which are engaged with one another, so that the outer disk carrier of the second powershiftable clutch is permanently driven by the outer disk carrier of the first powershiftable clutch. The outer disk carrier of the second powershiftable clutch can be made integrally with the first intermediate shaft and the inner disk carrier of the second powershiftable clutch can be made integrally with the second driving pinion. The third driving pinion can be made integrally with the second intermediate shaft. "Made integrally" means that the components are both produced from a single blank. The embodiment variants mentioned in the present paragraph advantageously reduce the number of components and the fitting space required. Thus, disadvantageous manufacturing tolerances in the production and assembly of the individual components can in that way be avoided.

In practice, marine transmissions are often used, in which a drive output gearwheel arranged on a drive output shaft engages with a plurality of driving pinions and drive output power is transmitted to the drive output shaft, as chosen, by way of one of the driving pinions. The above-mentioned preferred arrangement of the components thus enables a simple integration of the present invention into existing marine drive arrangements and allows the use of tried and tested components. In that way, moreover, a large number of identical components can be used, which brings cost advantages. The advantage can be used to still better effect if the first, second and third driving pinions all have the same number of teeth in accordance with a further preferred design. Thus, in particular the three driving pinions can be made identically. That has the result that the gear ratio when any one of the three driving pinions drives the drive output shaft always has the same value.

Furthermore the marine transmission can comprise a shiftable clutch by means of which the third driving pinion can be connected to the electric machine. Advantageously, in that way various operating modes for operating the proposed marine transmission or drive arrangement can be obtained. In this context operating modes are possible in which the electric machine is coupled to the drive output shaft of the marine transmission, and other operating modes in which the electric machine is decoupled from the drive output shaft. For example a purely electric drive mode can be obtained, in which the vessel is propelled exclusively by the electric machine. In addition the drive output shaft can also be driven only by the motor of the main drive or by the main drive motor and the electric machine simultaneously. To do that, the shiftable clutch is provided in the drive arrangement, by means of which the electric machine can be coupled or decoupled. The positioning of the shiftable clutch in the marine transmission allows a compact structure of the drive arrangement. The shiftable clutch too is designed to be powershiftable, for example in the form of a friction-disk clutch. However it is in this case also conceivable to use a non-powershiftable, interlocking clutch, wherein the rotational speeds when coupling can be synchronized by the rotational speed control system of the electric machine. Compared with a friction clutch, an interlocking clutch can be more compact.

It is also conceivable to position a possible way to couple and decouple the electric machine at some other point of the drive-train, for example on the planetary gear assembly. However, when the electric machine is not being used, the preferred arrangement of a shiftable clutch in the marine transmission, and therein, in particular, close to the third driving pinion, enables as many components of the drive-train as possible to remain static with the electric machine and not to have to be accelerated and braked. This results in a saving of energy.

To further increase the gear ratio of the electric machine in the drive-train, it is preferably provided that between the planetary gear assembly and the second intermediate shaft a spur gear stage is arranged. In that way the electric machine can be operated at particularly high rotational speeds. As explained above, higher rotational speeds of the electric machine enable the electric machine to have compact dimensions in relation to its power output.

The compact dimensions of the electric machine result in a further advantage, namely a low weight and a low mass of the electric machine. In turn, this makes it possible to flange-mount the electric machine directly onto the marine transmission. For that possibility it is preferably provided that the marine transmission has a housing and the housing has a flange for attaching the electric machine. In that way no further fixing elements or foundation are needed in the hull of the vessel for the electric machine. It is therefore also possible for a marine transmission according to the invention with an additional drive to be retrofitted in an existing vessel without having to make modifications to the hull of the vessel. The marine transmission with the electric machine can be assembled completely and fitted into the hull of a vessel as a structural unit. That simplifies the installation work. The flange can for example be arranged on a partial housing of the planetary gear assembly when the planetary gear assembly is constructed as a separate unit, as explained further below.

According to another preferred embodiment, the planetary gear assembly and/or the spur gear stage can each be made as a separate structural unit. This means that a basic transmission and the planetary gear assembly or spur gear stage made as a separate structural unit each has a partial housing of its own. The partial housings together form the housing of the marine transmission.

In that case the basic transmission can for example comprise the main driveshaft, a first and a second intermediate shaft, two powershiftable clutches and a drive output shaft, as well as a partial housing with mounting points for the components. This design with separate structural units makes possible a so-termed modular concept or modular structure. For this, identical components such as the basic transmission and its partial housing can be used for various applications in different combinations with the other separate structural units. In the present case, for example, an identical partial housing of the basic transmission with the main driveshaft, at least a first intermediate shaft, and a drive output shaft can be used with and without the electric machine. In that way larger production runs of the identically usable components and consequently cost savings can be achieved. If the planetary gear assembly is made as a separate structural unit, its respective design can be adapted to various types of electric machines without having to modify the basic transmission. For example a planetary gear assembly can comprise one or more planetary gearsets, whereby various gear ratio ranges and/or a rotational direction reversal can be realized for various applications.

Finally, the present invention includes a drive arrangement for a marine drive with a main drive motor, and with a marine transmission which is designed in accordance with one of the embodiments described earlier. Besides its function as an additional drive, the electric machine can also be used as a generator if, for example, it is powered by the main drive motor via the marine transmission.

BRIEF DESCRIPTION OF THE DRAWINGS

Below, the invention and its advantages are explained in greater detail with reference to the example embodiment illustrated in the attached FIGURE.

The sole FIGURE shows a schematic representation of a drive arrangement according to the invention, with a marine transmission.

DETAILED DESCRIPTION OF THE PREFERRED EMBODIMENTS

The drive arrangement shown in sole FIGURE comprises a marine transmission 1 with a main driveshaft 3, which is connected to a main drive motor 2 via a non-switchable coupling 19. The main driveshaft 3 is arranged coaxially with an output shaft of the main drive motor 2. The non-shiftable coupling 19 can consist essentially of two screw flanges bolted to one another, which are fixed permanently to the respective ends of the shafts with which they are associated. Typically the main drive motor 2 is in the form of an internal combustion engine and during most of the travel time serves as the source of drive power for propelling a vessel in which it is installed. Furthermore the marine transmission 1 comprises a first intermediate shaft 4, a second intermediate shaft 5 and a drive output shaft 6, which shafts in the present example embodiment are all arranged parallel to the main driveshaft 3. By way of the drive output shaft 6 a propeller shaft 20 with a propeller 21 fixed on it can be driven. For that purpose the drive output shaft 6 is connected to the propeller shaft 20 by a non-switchable coupling 22.

A drive output gearwheel 14 arranged on the drive output shaft 6 is permanently engaged with a first driving pinion 11, with a second driving pinion 12 and with a third driving pinion 13. The first driving pinion 11 can be connected to the main driveshaft 3 by a first powershiftable clutch 15. The second driving pinion 12 can be connected to the first intermediate shaft 4 by a second powershiftable clutch 16. In this example embodiment the first and second powershiftable clutches 15 and 16 are of identical design.

The third driving pinion 13 is connected in a rotationally fixed manner to the second intermediate shaft 5. In the present case the third driving pinion 13 is connected permanently to the second intermediate shaft 5. In this example embodiment the first, second and third driving pinions 11, 12, 13 are all of identical design, whereby their production costs are reduced.

On the marine transmission 1, an electric machine 7 is provided as an additional drive. The electric machine 7 can be connected to the second intermediate shaft 5 by way of a planetary gear assembly 8, and a spur gear stage 9 is associated with the second intermediate shaft 5, by virtue of which a still larger gear ratio is produced between the electric machine 7 and the drive output shaft 6.

The marine transmission 1 also comprises a shiftable clutch 10 by means of which the third driving pinion 13 can be connected to the electric machine 7. The shiftable clutch 10 can be activated by a control unit. In that way the additional drive-train with the electric machine 7 can be coupled and decoupled as necessary or in accordance with the operating mode desired. The shiftable clutch 10 is arranged in the housing 17 of the marine transmission 1 directly adjacent to the third driving pinion 13. This arrangement of the shiftable clutch 10 directly adjacent to the third driving pinion 13 has a further advantage. In the operating modes in which the electric machine 7 is decoupled from the drive output shaft 6, all the other components of the additional drive-train can remain static, for example the planetary gear assembly 8 and the spur gear stage 9. This contributes toward energy-saving operation.

The planetary gear assembly 8 and the spur gear stage 9 are each made as separate assemblies. In other words the basic transmission, the planetary gear system 8 and the spur gear stage 9 each have a respective partial housing 24, 25 and 26 of their own. Thus other drive arrangements as well, with the identical components, can be provided, which for example are configured without the spur gear stage 9. In that case the partial housing 24 of the planetary gear assembly 8 can be flange-mounted directly onto the partial housing 26 of the basic transmission.

The housing 17 of the marine transmission 1 accordingly comprises all the partial housings 24, 25 and 26. In other example embodiments the basic transmission, together with the planetary gear assembly 8 and the spur gear stage 9, can be accommodated in a common housing 17.

On the partial housing 24 of the planetary gear system 8, a flange 18 is provided for connecting the electric machine 7. In the present example embodiment, however, the flange is not used for flange-mounting the electric machine 7. Instead, in this case the electric machine 7 is positioned a distance away from the planetary gear assembly 8 and connected thereto by a non-shiftable coupling.

INDEXES

1 Drive arrangement
2 Main drive motor
3 Main driveshaft
4 First intermediate shaft
5 Second intermediate shaft
6 Drive output shaft
7 Electric machine
8 Planetary gear assembly
9 Spur gear stage
10 Switchable clutch
11 First driving pinion
12 Second driving pinion
13 Third driving pinion
14 Drive output gearwheel
15 First powershiftable clutch
16 Second powershiftable clutch
17 Housing
18 Flange
19 Non-switchable coupling
20 Propeller shaft
21 Propeller
22 Non-switchable coupling
23 Non-switchable coupling
24 Partial housing
25 Partial housing
26 Partial housing

The invention claimed is:

1. A marine transmission comprising:
a main driveshaft that is connectable to a main drive motor,
a first intermediate shaft,
a second intermediate shaft,
a drive output shaft by way of which at least one propeller is drivable,
a drive output gearwheel, arranged on the drive output shaft, being engaged with a first driving pinion, a second driving pinion and a third driving pinion,
the first driving pinion being connectable, by a first powershiftable clutch, to the main driveshaft,
the second driving pinion being connectable, by a second powershiftable clutch, to the first intermediate shaft,
the third driving pinion being rotationally fixedly connected to the second intermediate shaft,
the marine transmission comprising an electric machine, as an additional drive, and a planetary gear assembly, and
the electric machine being connectable to the second intermediate shaft of the marine transmission by the planetary gear assembly.

2. The marine transmission according to claim 1, wherein the first driving pinion, the second driving pinion and the third driving pinion all have a same number of teeth.

3. The marine transmission according to claim 1, wherein the marine transmission comprises a shiftable clutch by which the third driving pinion is connectable to the electric machine.

4. The marine transmission according to claim 1, wherein a spur gear stage is arranged between the planetary gear assembly and the second intermediate shaft.

5. The marine transmission according to claim 4, wherein at least one of the planetary gear assembly and the spur gear stage, respectively, are made as a separate structural unit.

6. The marine transmission according to claim 1, wherein the marine transmission has a housing, and the housing has a flange for attaching the electric machine.

7. A drive arrangement for the marine transmission with the main drive motor and with a marine transmission according to claim 1.

8. A marine transmission comprising:

a main driveshaft, first and second intermediate shafts a drive output shaft, the main driveshaft being connectable to a main drive motor which drives, via the drive output shaft, at least one propeller, a drive output gearwheel, arranged on the drive output shaft, being engaged with first, second and third driving pinions, the first driving pinion being connectable, by a first powershiftable clutch, to the main driveshaft, the second driving pinion being connectable, by a second powershiftable clutch, to the first intermediate shaft, the third driving pinion being fixedly connected to the second intermediate shaft, the marine transmission comprising an electric machine, as an additional drive, and a planetary gear assembly, and the electric machine being connectable, via the planetary gear assembly, to the second intermediate shaft of the marine transmission.

* * * * *